United States Patent [19]

Concato

[11] Patent Number: 4,610,040

[45] Date of Patent: Sep. 9, 1986

[54] AUTOMATIC FEET WASHING AND MASSAGING MACHINE

[75] Inventor: Antonio Concato, Genova Pegli, Italy

[73] Assignee: Sander S.R.L., Genoa, Italy

[21] Appl. No.: 708,821

[22] Filed: Mar. 6, 1985

[30] Foreign Application Priority Data

Mar. 13, 1984 [IT] Italy ..... 12458 A/84

[51] Int. Cl.[4] ..... A47K 3/022

[52] U.S. Cl. ..... 4/622; 15/21 R

[58] Field of Search ..... 4/622; 15/21 R, 21 E, 15/97 R; 128/44–53, 56, 65, 66, 365, 370

[56] References Cited

U.S. PATENT DOCUMENTS

| | | | |
|---|---|---|---|
| 3,108,299 | 10/1963 | Baldwin | 15/21 R |
| 3,150,399 | 9/1964 | Dick et al. | 15/56 X |
| 3,359,572 | 12/1967 | Blackwell | 4/622 |
| 3,810,463 | 5/1974 | Krummenacher | 15/21 R X |
| 3,939,825 | 2/1976 | Krummenacher | 15/21 R X |
| 4,025,981 | 5/1977 | Root et al. | 15/21 R |
| 4,485,503 | 12/1984 | Rolando et al. | 4/622 |

FOREIGN PATENT DOCUMENTS

| | | | |
|---|---|---|---|
| 0066555 | 8/1982 | European Pat. Off. | 4/622 |
| 2940410 | 4/1981 | Fed. Rep. of Germany | 4/622 |

*Primary Examiner*—Charles E. Phillips

*Attorney, Agent, or Firm*—Larson and Taylor

[57] ABSTRACT

The object of the invention is a feet washing and massaging machine having a basin (1) which is adapted for containing either one or both feet (2) placed on a footrest grid (3). On each foot (2) there acts a set of brushes (35,42,44) which is moved to and fro along the foot (2) and is carried by a pair of brush-carrying arms (33) which are introduced from above in the basin (1) and are driven by an electric motor (21) located outside of the basin (1), at a certain height thereover. The motor (22) is arranged on a support structure (11) containing the mechanical and electrical controls for the brush-carrying arms (33). The operative cycle of the machine is controlled by a programmer (48).

12 Claims, 6 Drawing Figures

AUTOMATIC FEET WASHING AND MASSAGING MACHINE

BACKGROUND AND SUMMARY OF THE INVENTION

The object of the invention is an automatic feet washing and massaging machine, which comprises a basin for at least one foot, means for filling the said basin with water and for discharging the water from the basin, and one or more brushes acting upon the foot placed in the basin.

Machines of this type are known, in which one or more rotary brushes are mounted in the basin. The basin holds both the rotary bearings for these brushes and the electric motor for operating same. The result is that problems of water tightness and safety against accidents, as well as difficulties in construction and maintenance, are encountered.

The purpose of the invention is to eliminate these and other drawbacks in the known embodiments by providing a machine as described in the preamble, characterized in that the brush or brushes are mounted on at least one movable brush-carrying arm which is introduced from above into the basin, and which is driven by a driving unit with at least its electric motor placed on a support outside of the basin, at a certain height thereover.

In this way, in the feet washing machine according to the invention, the brush or the brushes and their driving unit are quite independent from the basin and can be also fully separated therefrom. The basin does not require means for supporting the brush or brushes, so that any relevant problems of construction and tightness are eliminated. The electric motor of the unit for driving the brush-carrying arm is located outside of the basin at a certain height thereover, and therefore away from the water, whereby the maximum of safety is ensured.

According to a further advantageous characteristic feature of the invention, the driving unit for the movable brush-carrying arm is so constructed as to impart to the brush-carrying arm a reciprocating movement by which the brush or brushes mounted on the brush-carrying arm are moved forward and backward along the foot put in the basin. Thus, with the machine according to the invention not only a good washing of the whole foot is obtained, but also a beneficial massage action.

In one preferred embodiment of the invention, to each one of the feet put in the basin there become associated two brush-carrying arms located at either sides of the respective foot and carrying at least one downwardly turned upper brush, at least one upwardly turned lower brush, and two side brushes turned the one toward the other, the brush-carrying arm driving unit being made in such a manner that the upper brush is moved along the foot plant and around the heel, and the two side brushes are moved along the foot sides as far as or beyond the ankle region.

The brush or brushes mounted on the brush-carrying arm or arms can be stationary or at least in part rotary brushes. Preferably, at least the two side brushes are rotary brushes, and their rotation is derived from the reciprocating movement of the brush-carrying arms, thus avoiding special driving motors.

BRIEF DESCRIPTION OF THE DRAWINGS

Other features and advantages of the invention will appear in the dependent claims and in the following specification of one preferred embodiment of the invention shown in the drawings, in which:

DESCRIPTION OF THE PREFERRED EMBODIMENT

Figure 1:
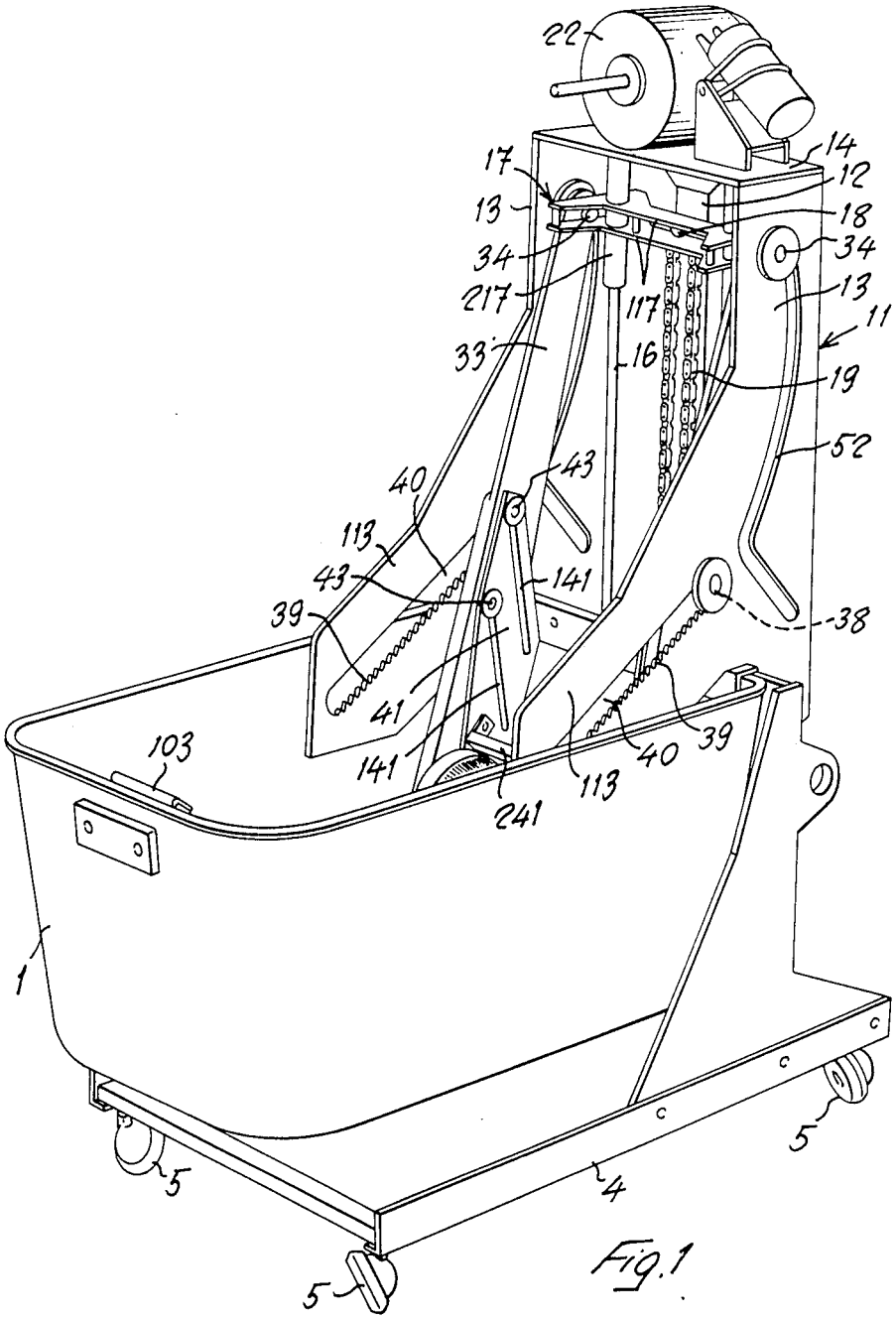
FIG. 1 shows in perspective a machine according to the invention, for washing and massaging one foot at a time.
Figure 2:
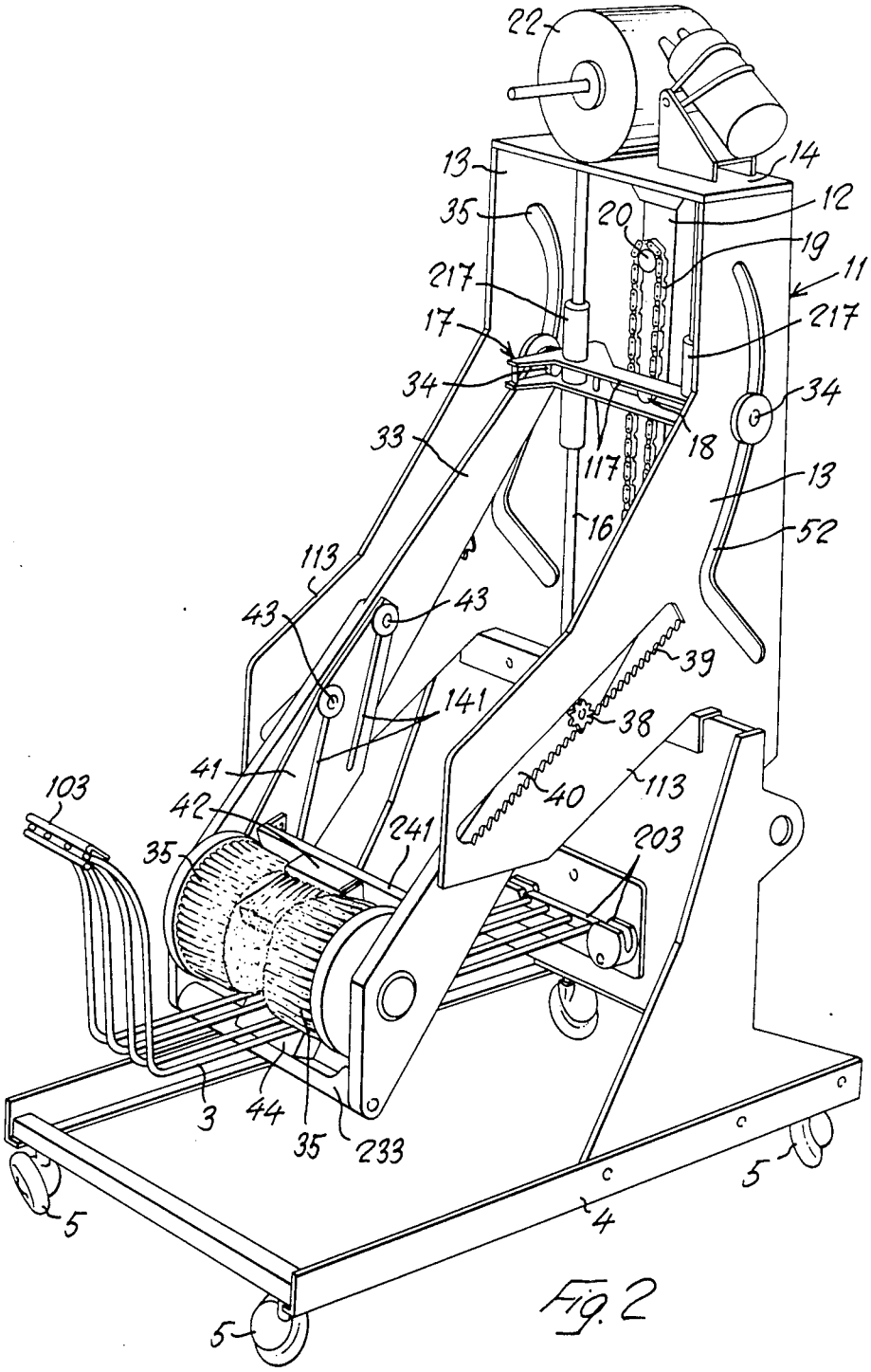
FIG. 2 shows in perspective the machine according to FIG. 1, without the basin.

Referring to FIGS. 1 to 5, the shown feet washing and massaging machine comprises a basin 1 which is meant for accomodating one foot 2. In the basin 1 a footrest grid 3 is provided and extends substantially horizontally at a certain distance from the bottom of basin 1. On the fore side, turned toward the user, of basin 1 the footrest grid 3 is bent upwardly at the interior of basin 1 as far as the upper edge thereof, whereby a seat 2 for the heel of foot 2 is formed, as it appears particularly in FIG. 3. By its ends 103 and 203 the foot bearing grid 3 is fastened to basin 1 in an easily removable and disassemblable manner.

The basin 1 is mounted on a support base frame 4 which may be provided with castor wheels 5 whereby it is easily movable within certain limits, or it may be fixed so as to be stationary. The lowermost point of the inclined bottom of basin 1 is connected to a discharge pipe through a pump 7 for emptying the basin. At the upper section of basin 1 a washing water delivery pipe 8 extends along at least one portion of the edge, and preferably along the whole perimeter of said basin 1. This delivery pipe 8 is provided with a plurality of perforations, like for a shower, and is connected through a feed pipe 9 to a warm and cold water mixing unit. In the feed pipe 9 there is provided an electric valve 10. The discharge pipe 6 and the feed pipe 9 are provided in correspondence of the rear side of basin 1, lying opposite to the user, and are made as hoses when the support base frame 4 of basin 1 is provided with wheels.

At the exterior of basin 1 an upstanding support structure 11 is provided in correspondence of the rear side thereof, and is fastened to the base frame 4, and comprises an upright 12, two side members 13, an upper crosspiece 14 and a lower crosspiece 15.

Between the two crosspieces 14 and 15 two parallel guide rods 16 are fastened, on which a carriage 17 is mounted for sliding vertically. In the shown embodiment this carriage 17 consists of two superposed, spaced apart horizontal plates 117. The plates 117 are interconnected by means of vertical sleeves 127, by which they are also slidably mounted on rods 16.

During the operation of the machine, the carriage 17 is so driven as to perform an up and downward reciprocating movement on rods 16. To this end, between the two plates 117 of carriage 17 there is engaged a driving pin 18 provided with a roller and fastened to an endless chain 19 which extends vertically, parallelly to the two guide rods 16, and is led over two sprocket wheels 20 and 21. The upper sprocket wheel 20 is driven through a reduction gearing by an electric motor 22. In the shown embodiment, the driving motor 22 is secured to the upper crosspiece 14, and through a chain 24 its pinion 23 drives a sprocket wheel 25 mounted for a free rotation on a shaft 26 carried by the upright 12. On said shaft 26 there is mounted a sprocket wheel 27 which through a chain 28 is connected to a sprocket wheel 29 which in turn is connected with the upper guide sprocket wheel 20 for chain 19. The two sprocket wheels 25 and 27 on shaft 26 are interconnected through an interposed clutch 30 which is kept engaged by an adjustable spring, and which is disengageable by the action of an electromagnet 32, for example, by means of a lever 31. All the chains 19,24,28 can be also replaced with cog belts.

At each side of the footrest grid 3 there is arranged a brush-carrying arm 33 having its upper end pivotally connected to carriage 17, in such a manner that it can perform both a swinging movement about a horizontal transverse axis, and a horizontal sliding movement perpendicular to the said axis of oscillation. In the shown embodiment, each brush-carrying arm 33 has at its upper end a transverse pin 34 projecting from both sides, and which by one of its ends provided with a roller is engaged between the two plates 117 of carriage 17. The other end of said pin 34 also provided with a roller, is engaged in a shaped slot 52 formed in the respective side 13 of the support structure 11. On the lower end of each brush-carrying arm 33 there is mounted a rotary disc brush 35 so as to be directed toward the foot-bearing grid 3. The rotation of this brush 35 is derived from the movement of the respective brush-carrying arm 33. To this end, a pinion 36 which is co-axial to, and is integral with the brush 35, is connected through a gear train 37 carried by the brush-carrying arm 33, to a pinion 38 which is mounted on said brush-carrying arm 33 and is in mesh with a fixed rack 39 which is integral with a forward extension 113 of side 13. More particularly, the rack 39 is provided in correspondence of one edge of an inclined slot 40 formed in extension 113 of side 13, and in which the pinion 38 is engaged. Thus, the pinion 38 and then the corresponding point of the brush-carrying arm 35, are guided along the inclined slot 40. In the shown embodiment, both brush-carrying arms 33 are made in form of hollow arms, and the respective gear trains 37 are housed at the inside thereof.

On the facingly arranged inner sides of the two brush-carrying arms 33 brush-carrying plates 41 are mounted, which are interconnected by means of a cross member 241 and carry, in correspondence of this member, between the two rotary side brushes 35, an intermediate upper brush 42, which is provided in a downwardly turned arrangement at a certain level over the footrest grid 3. The brush-carrying plates 41 are slidingly guided substantially in the vertical direction on the respective brush-carrying arms 33, and to this end they present parallel slots 141, in which pins 43 secured to the brush-carrying arms 33, are engaged. The intermediate upper brush 42 can be urged downward by gravity or by the action of suitable spring means (not shown). Underneath the footrest grid 3 an intermediate lower brush 44 is fastened in an upwardly turned arrangement to a cross member 233 rigidly interconnecting the lower ends of the brush-carrying arms 33. The bristles of this intermediate lower brush 44 pass through the footrest grid 3.

The above-disclosed feet-washing machine may be also provided with a feet-drying device which comprises a fan 45 with its delivery duct provided with a magnet-controlled valve 51, and connected to a median blowing duct 46 which is directed from above toward the footrest grid 3. Off this median blowing duct 46 there can be branched two lateral blowing ducts 146 extending almost as far as the footrest grid 3, at both sides thereof. In the delivery duct 145 of fan 45 there is arranged a resistance 47 which is licked by air and so provides to the heating of same. The fan 45 may be operated by its own motor. However, in the shown embodiment, the fan 45 is operated by the same electric motor that drives also the brush-carrying arms 33. In this case, the rotation of fan 45 is in the reverse direction to the driving direction of the endless chain 19 engaged with the carriage 17. The motor 22 therefore is of the reversible type, and between the sprocket wheel 29 and the upper sprocket wheel 20 for guiding the chain 19 there is interposed a free wheel 129.

The feet-washing machine is provided with a programmer 48 that controls the brush arms-driving electric motor 22, the water-infeed valve 10, the basin-emptying pump 7, the electromagnet 32 of the clutch between the two sprocket wheels 25, 27, the electromagnet controlling the valve 51 in the delivery duct 145 of fan 45, and the respective air-heating resistance 47 in such a manner that the following operation is obtained.

The user sets the machine in operation by means of a main switch 49, and then, by pressing a pushbutton 50, the user begins the first step of the cycle, in which the water temperature is adjusted. For this purpose, the programmer 48 opens the water-infeed electric valve 10 and simultaneously actuates the basin-emptying pump 7, so that through the perforated delivery pipe 8 the water flows into the basin 1 and is discharged by the pump 7. The user adjusts the temperature of water by manually acting upon the mixer connected to the feed pipe 9. When the water supplied to basin 1 has the desired temperature, the user promotes the end of the first step and the beginning of the second step by pressing again the pushbutton 50. The programmer 48 then stops the basin-emptying pump 7 while it still leaves the water-infeed electric valve 10 open, until the basin 1 is filled up to a predetermined level. The water-infeed electric valve 10 is then closed by the programmer 48 as a result of a signal from any automatic device for measuring the level in basin 1, known per se and not shown.

The user now puts his foot 2 in the basin 1 on the footrest grid 3 and by pressing again the pushbutton 50, starts the next third step, i.e. the step of washing and massaging his foot. By actuating the pushbutton the driving motor 22 is started, while the valve 51 in the delivery duct 145 of fan 45 is kept closed, and the respective water-heating resistance 47 is off. The endless chain 19 is then set in motion, and its driving pin 18 imparts the carriage 17 a reciprocating up and downward motion on the guide rods 16. The carriage 17 in its turn imparts to the pair of brush-carrying arms 33 a compound movement consisting in the vertical up and downward movement of the upper pins 34 of the two brush-carrying arms 33 and in the simultaneous horizontal movement that the said pins 34 perform relatively to the carriage 17, while following their track in the shaped slots 35 provided in the machine sides 13. Moreover, the two brush-carrying arms 33 have their pinions 38 compelled to run along the inclined slots 40 provided in the forward extensions 113 of said sides 13.

Figure 3:
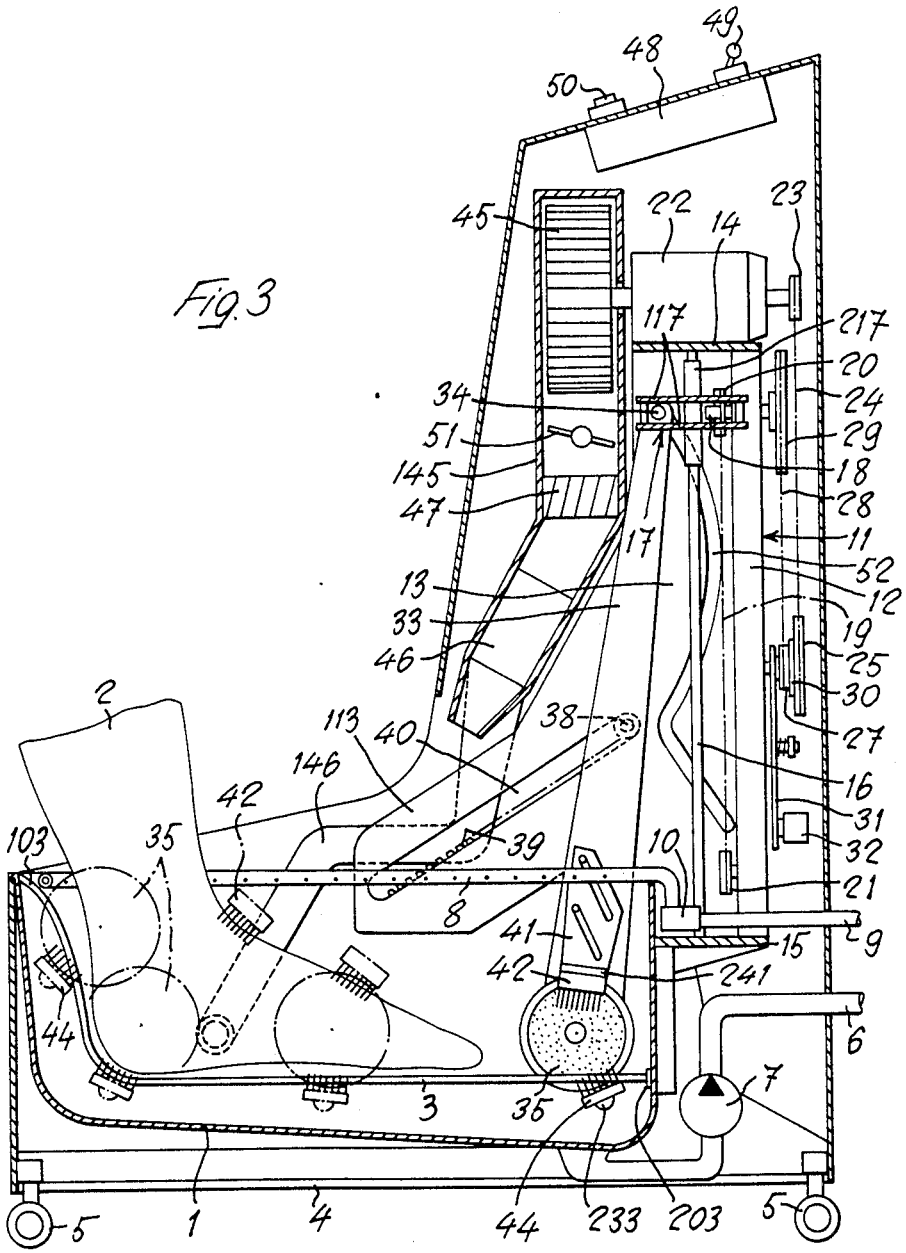
FIG. 3 is a diagrammatical sectional view of the machine according to FIGS. 1 and 2.
Figure 4:
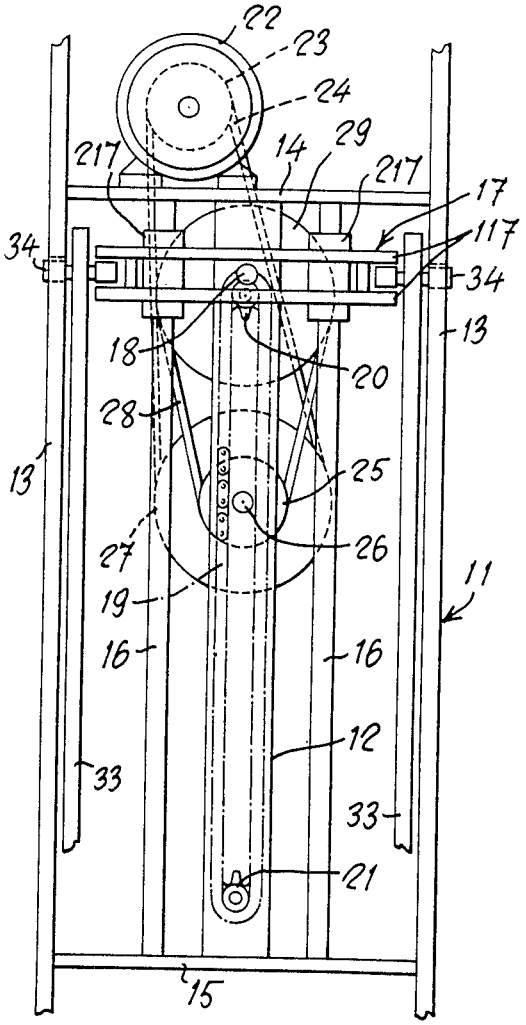
FIG. 4 is a rear elevational view showing a part of the transmission for the brush-carrying arms driving unit.
Figure 5:
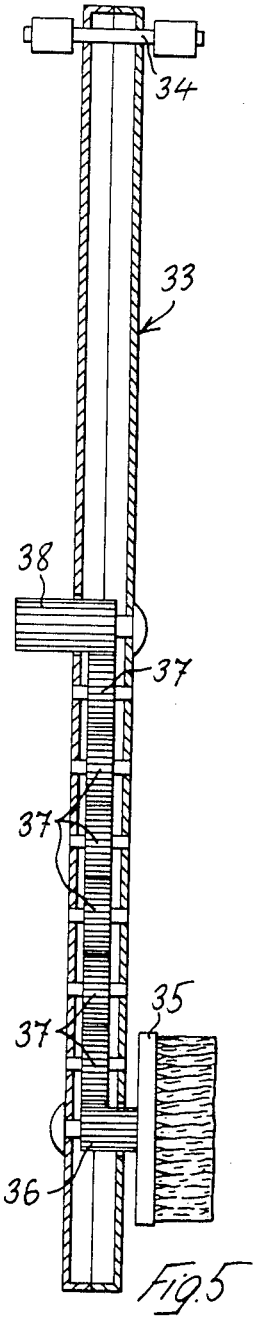
FIG. 5 is a longitudinal sectional view of a brush-carrying arm.

The result is a compound movement of the pair of brush-carrying arms 33, such that the set of brushes 35,42,44 at the lower end of the brush-carrying arms 33 is reciprocatingly moved to and fro along the foot 2 placed on the footrest grid 3, as shown by dash-and-dot lines in FIG. 3. More particularly, the median upper brush 42 is moved along the dorsum of foot 2 and follows the profile thereof by being up and down moved with respect to the brush-carrying arms 33, along with the cross member 241 and the brush-carrying plates 41. The lower brush 44 is moved along the plant of foot 2 and around the heel thereof, as far as a certain height above the heel. The two side brushes 35 are moved along the sides of foot 2, and are caused to reach the region of the ankle and even a region thereover. At the same time, the two side brushes are rotated by the action of their respective pinions 38 which during the above-disclosed movement of the brush-carrying arms 33, are rolling on the corresponding racks 34 in slots 40, and through the gear trains 37 transmit their rotation to the side brushes 35. All the brushes 35,42,44 act upon the foot 2 and produce a thorough washing and a simultaneous massage thereof.

An excessive resistance possibly encountered by the brush-carrying arms 33 during the foot washing and massaging cycle determines the slipping of clutch 27, whereby it also functions as an automatic safety member.

When the user wants to put an end to the washing step, it presses again the pushbutton 50, and so it starts the fourth step, in which the programmer 48 sets in operation the basin-emptying pump 7 which discharges the water from the basin 1, while the electric valve 10 is being opened, so that the whole foot will be rinsed by a shower with the water delivered through the perforations in the delivery pipe 8 extending all around the foot 2. The movement of the brush-carrying arms 33, and therefore of the set of brushes 35,42,44, is still continued for a short time until the programmer 48 disengages, for example by the aid of suitable position sensors (not shown), the clutch 27 through the electromagnet 32, thus blocking the set of brushes 35,42,44 in their rear end position, fully retracted from foot 2, which is shown in FIG. 1 and with solid lines in FIG. 3. At this point the electric driving motor 22 is also stopped, and with the motor installing condition, the electromagnet 32 is de-energized. The foot 2 is thus let entirely free. To rinse the basin, the outflow of water from the perforations in the delivery pipe 8 is continued still for a certain time, and the operation of the basin-emptying pump 7 is also continued.

The foot washing and massaging cycle could terminate with the above-disclosed fourth step if the machine would not be provided with a warm air foot-drying device, as in the shown embodiment. In this embodiment, the user presses once more the pushbutton 50 whereby it starts the fourth step of the cycle, in which the programmer 48 closes the electric valve 10 and stops the pump 7, while it reverses the direction of rotation of motor 22, thus setting in operation the fan 45, opens the valve 51 by means of the electromagnet controlling same, and inserts the resistance. Therefore, the brush-carrying arms 33 remain stationary in their position retracted from foot 2, and a warm air stream flowing out of the intermediate blowing duct 46 and of the lateral blowing ducts 146 runs over the foot 2. Consequently, the whole foot 2 is dried in a short time. Once the drying step has been completed, the user presses again the pushbutton 50, thus ending the whole cycle. The user then draws the washed foot out of the basin 1 and puts in the basin its other foot, for which it repeats the above-disclosed washing and massaging cycle.

It is apparent that all the operations carried out by the machine are programmed as to their performance and sequence, but that it is possible for the user to determined their duration according to its own requirements by promoting the beginning of each step of the cycle and therefore the duration of the preceding step, through the actuation of only one control pushbutton 50.

Figure 6:
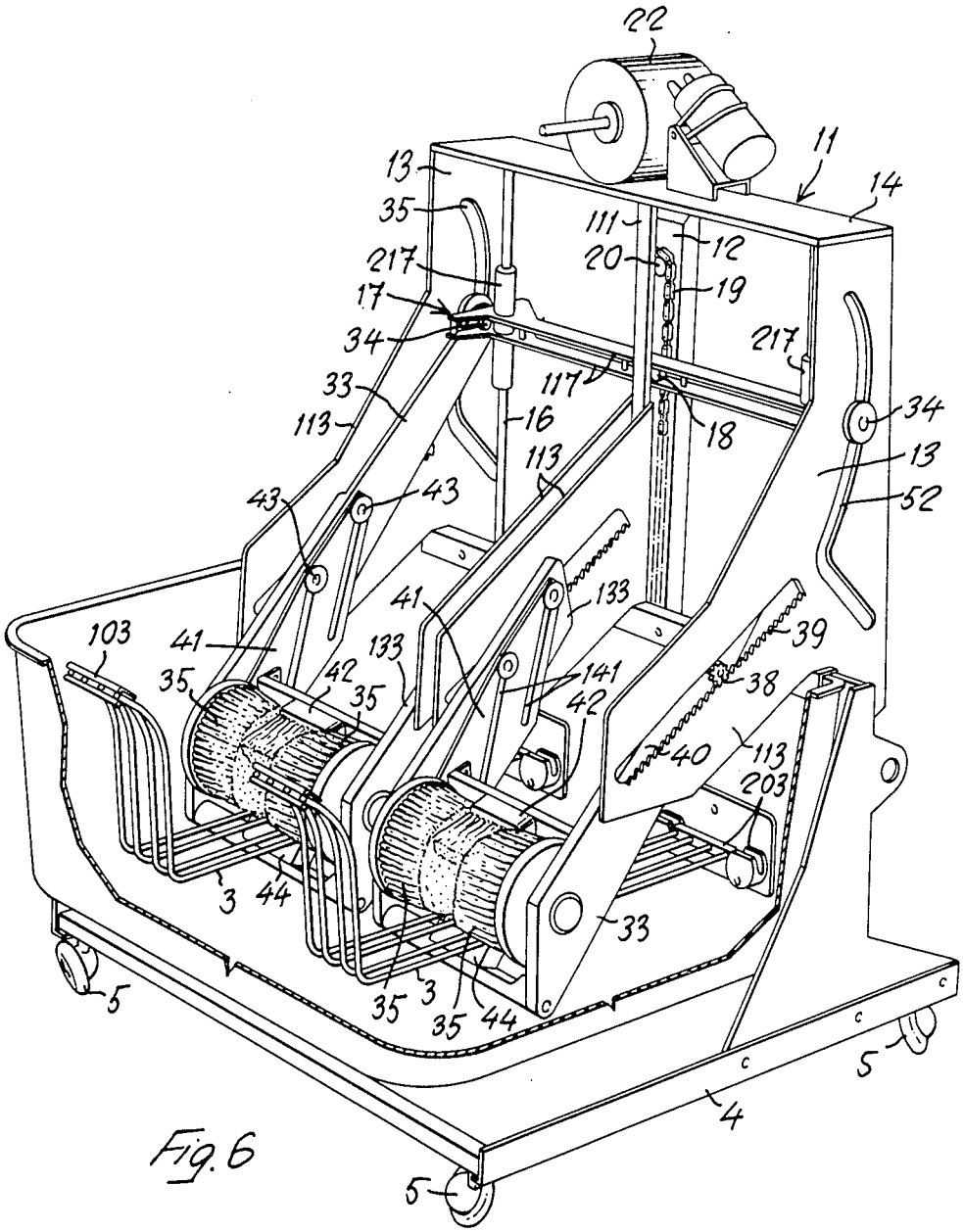
FIG. 6 shows in perspective a machine according to the invention for simultaneously washing both feet.

The embodiment of the feet-washing machine according to FIG. 6 permits the simultaneous washing and massaging of both feet. The basin 1 is therefore made wider and contains two side-by-side footrest grids 3 to each one of them there is associated a set of brushes 35, 42,44 like the one described by referring to FIGS. 1 to 5. Each set of brushes 35,52,44 is mounted on two brush-carrying arms 33, 133. The two outer brush-carrying arms 33 are constructed and driven in the same way as previously described, and have their upper ends engaged in a carriage 17 which is reciprocatingly driven up and down by one electric driving motor 22. The two inner brush-carrying arms 133 are instead made shorter and practically extend as far as their respective pinion 38. The slots 40 and the racks 39 for the pinions 38 of these shorter inner brush-carrying arms 133 are formed in two side-by-side extensions 133 which are fastened to a central upright 111 of structure 11. For the rest, the twin feet-washing machine according to FIG. 6 works in the same manner as the single feet-washing machine according to FIGS. 1 to 5.

In the first step of the cycle, when the adjustment of the water temperature is obtained automatically, for example through a thermostat, this first step is automatically terminated once the previously predetermined temperature has been reached, and the second step is started without having to press the pushbutton 50.

I claim:

1. An automatic feet washing and massaging machine comprising a basin for at least one foot, means for filling the said basin with water and for discharging the water from the basin, and a plurality of brushes acting upon the foot put in the basin, the plurality brushes being mounted on at least one movable brush-carrying arm which is introduced from above in the basin, and is driven by a driving unit of which at least its electric motor is placed on a support outside of the basin at a certain height thereover, said unit for operating the brush-carrying arm being made in such a manner as to impart to the brush-carrying arm a reciprocating motion, whereby the brushes mounted on the brush-carrying arm are moved to and fro along the foot put in the basin, two said brush-carrying arms being associated with each foot put in the basin, and said two arms being arranged at both sides of the respective foot, said brush-carrying arms carrying at least one downwardly turned upper brush, at least one upwardly turned lower brush, and two side brushes which are turned the one toward the other, the unit for driving the brush-carrying arms being constructed in such a manner that the upper brush is moved along the dorsum of foot, while the lower brush is moved along the plant of foot and around its heel, and the two side brushes are moved along the sides of foot up to and beyond the region of the ankle.

2. The machine according to claim 1, characterized in that the two side brushes are rotary brushes, and their rotation is derived from the reciprocating movement of the brush-carrying arms.

3. The machine according to claim 2, characterized in that the two brush-carrying arms have their lower ends interconnected by a cross member on which the lower brush is fastened, while the upper brush bears by gravity on the dorsum of foot and is fastened to a cross member carried by side plates which are so guided as to be moved in a substantially vertical direction on the brush-carrying arms.

4. The machine according to claim 3, characterized in that at least one of the brush-carrying arms is mounted by its upper end so as to be vertically swingable about a transverse pin which is so mounted as to be slidable horizontally and transversely to itself in a carriage which is slidable in vertical guides and is imparted a reciprocating up and downward motion by an electric driving motor and through a reduction gearing, the said brush-carrying arm furthermore having its upper pin guided along a first fixed guide, and at an intermediate point in a second fixed guide.

5. The machine according to claim 4, characterized in that the first fixed guide consists of a shaped slot in a side of a fixed structure.

6. The machine according to claim 5, characterized in that the second fixed guide consists of an inclined straight slot in an extension (113) of the fixed structure.

7. The machine according to clam 6, characterized in that the rotary side brush of each brush-carrying arm is connected through a gear train housed in the interior of the brush-carrying arm to a pinion which is rotatably mounted on the brush-carrying arm and is in mesh with a rack which is parallel to the inclined rectilinear slot forming the second fixed guide for the brush-carrying arm.

8. The machine according to claim 7, characterized in that the drive for the up and down reciprocating carriage comprises an endless chain which is mounted on two guide sprocket wheels and is provided with a driving pin into engagement with the carriage one of the guide sprocket wheels being connected to the driving motor.

9. The machine according to claim 8, characterized in that in the drive for the up and down reciprocating carriage there is inserted an adjustable clutch which slips any time the moving brush-carrying arms encounter a predetermined maximum of resistance.

10. The machine according to claim 9, characterized in that it comprises a feet-drying device with one or more warm air blowing ducts directed toward the foot put in the basin, and connected to the delivery of a fan provided with an electric resistance for heating the blown air.

11. The machine according to claim 10, characterized in that at the interior of the basin a footrest grid is provided, which extends over the lower brush at a certain distance from the bottom of basin and from the front wall thereof.

12. The machine according to claim 11, characterized in that an electric valve for feeding water in the basin, a pump for emptying the basin, a pump for emptying the basin, the electric motor for driving the brush-carrying arms, electromagnetic means for the control of clutch in the drive for the brush-carrying arms, the fan of the feet-drying device, the electric resistance for heating the air of said device and an electromagnetically controlled valve provided in the delivery duct of fan are all controlled by a programmer which determines the operations of the successive steps of an operative cycle of the machine, and the transition from one step to the next one is either completely automatic or is performed manually by the user acting for starting each single step of the cycle.

* * * * *